US011898550B2

(12) United States Patent
Redmond et al.

(10) Patent No.: US 11,898,550 B2
(45) Date of Patent: Feb. 13, 2024

(54) PROGRESSING CAVITY PUMP CONTROL USING PUMP FILLAGE WITH PID BASED CONTROLLER

(71) Applicant: Schneider Electric Systems USA, Inc., Foxborough, MA (US)

(72) Inventors: James Redmond, Richmond (CA); Zackery Sobin, Raleigh, NC (US); Scott Guimond, Gatineau (CA)

(73) Assignee: Schneider Electric Systems USA, Inc., Foxborough, MA (US)

( * ) Notice: Subject to any disclaimer, the term of this patent is extended or adjusted under 35 U.S.C. 154(b) by 68 days.

(21) Appl. No.: 17/683,055

(22) Filed: Feb. 28, 2022

(65) Prior Publication Data

US 2023/0272793 A1 Aug. 31, 2023

(51) Int. Cl.

| | |
|---|---|
| ***F04B 49/20*** | (2006.01) |
| ***F04B 47/02*** | (2006.01) |
| ***E21B 43/12*** | (2006.01) |
| ***F04B 51/00*** | (2006.01) |
| ***E21B 47/008*** | (2012.01) |
| *E21B 47/10* | (2012.01) |

(52) U.S. Cl.

CPC ..... *F04B 49/20* (2013.01); *E21B 43/126* (2013.01); *E21B 47/008* (2020.05); *F04B 47/02* (2013.01); *F04B 51/00* (2013.01); *E21B 47/10* (2013.01); *F04B 2201/1201* (2013.01); *F04B 2205/09* (2013.01)

(58) Field of Classification Search

CPC ..... E21B 43/126; E21B 47/008; F04B 49/20; F04B 51/00; F04B 47/02; F04B 2201/1201; F04B 2205/09

See application file for complete search history.

(56) References Cited

U.S. PATENT DOCUMENTS 4,490,094 A * 12/1984 Gibbs ..... F04B 47/02 417/42
5,372,482 A * 12/1994 London ..... F04B 49/06 417/18
7,891,237 B2 * 2/2011 Mills ..... F04B 47/02 73/152.61
8,322,995 B2 * 12/2012 Ehimeakhe ..... E21B 43/127 700/282

(Continued)

*Primary Examiner* — Christopher S Bobish

(74) *Attorney, Agent, or Firm* — Locke Lord LLP

(57) ABSTRACT

System/method for real-time monitoring and control of pump operations at a well provide a pump control system that uses pump fillage with a proportional-integral-differential (PID) based algorithm to control positive displacement pump operations. The pump control system/method obtains measured or inferred pump speed from available pump speed data and, using certain pump characteristics provided by the well operator, calculates a theoretical fluid flow rate based on the pump speed. The pump control system/method thereafter compares the calculated theoretical fluid flow rate to a measured or observed fluid flow rate to calculate a pump fillage. The calculated pump fillage is then provided as a process input to the PID based algorithm along with a desired pump fillage from the well operator. The PID based algorithm processes the calculated pump fillage and the desired pump fillage using tuning parameters to determine an optimum pump speed based on the desired pump fillage.

20 Claims, 6 Drawing Sheets

(56) References Cited

U.S. PATENT DOCUMENTS

| | | | | |
|---|---|---|---|---|
| 8,328,527 | B2 * | 12/2012 | Ehimeakhe | E21B 47/009 73/239 |
| 9,528,355 | B2 * | 12/2016 | McCrickard | E21B 47/008 |
| 9,684,311 | B2 * | 6/2017 | Mancuso | G05D 9/12 |
| 10,107,286 | B2 * | 10/2018 | Mancuso | F04C 14/08 |
| 10,352,149 | B2 * | 7/2019 | Mills | E21B 47/009 |
| 10,408,205 | B2 * | 9/2019 | Sobin | E21B 43/127 |
| 10,428,627 | B2 * | 10/2019 | Elmer | E21B 43/129 |
| 2014/0088875 | A1 * | 3/2014 | Krauss | E21B 47/008 702/6 |
| 2015/0275651 | A1 * | 10/2015 | Chen | E21B 47/009 702/6 |
| 2016/0265321 | A1 * | 9/2016 | Elmer | F04B 47/022 |
| 2017/0016313 | A1 * | 1/2017 | Pons | G05D 7/0676 |
| 2017/0037845 | A1 * | 2/2017 | Al Assad | F04B 51/00 |
| 2017/0167482 | A1 * | 6/2017 | Assad | F04B 47/02 |
| 2020/0263530 | A1 * | 8/2020 | Perez | E21B 47/008 |
| 2023/0098068 | A1 * | 3/2023 | Peterson | G05D 9/12 166/250.15 |

* cited by examiner

PROGRESSING CAVITY PUMP CONTROL USING PUMP FILLAGE WITH PID BASED CONTROLLER

TECHNICAL FIELD

The present disclosure relates to monitoring oil and gas wells to ensure proper operation of the wells and more particularly to methods and systems for real-time monitoring and controlling of positive displacement pump operations at the wells, including progressing cavity pump (PCP) operations, using pump fillage with proportional-integral-differential (PID) based controllers.

BACKGROUND

Oil and gas wells are commonly used to extract hydrocarbons from a subterranean formation. A typical well site includes a wellbore that has been drilled into the formation and sections of pipe or casing cemented in place within the wellbore to stabilize and protect the wellbore. The casing is perforated at a certain target depth in the wellbore to allow oil, gas, and other fluids to flow from the formation into the casing. Tubing is run down the casing to provide a conduit for the oil and gas to flow up to the surface where they are collected. The oil and gas can flow up the tubing naturally if there is sufficient pressure in the formation, but typically pumping equipment is needed at the well site to provide artificial lift for the wellbore fluids.

Several types of artificial lift systems are known to those skilled in the art, including "sucker rod" or beam pumps, electric submersible pumps (ESP), reciprocating pumps, jet hydraulic pumps, and positive displacement pumps. One type of positive displacement pump that is particularly well adapted for a range of challenging artificial lift conditions is a progressive cavity pump (PCP). However, existing PCP based artificial lift systems require deploying sensors and instrumentation within the wellbore to monitor and control pump operations. These subsurface sensors measure various types of downhole parameters that can be used to optimize fluid production and minimize wear and tear on the pump. But the use of subsurface sensors presents a number of challenges for well operators, including high installation costs, reduced accuracy, and limited long-term reliability, among other issues.

Thus, while a number of advances have been made in the field of oil and gas production, it will be readily appreciated that improvements are continually needed.

SUMMARY

The present disclosure relates to systems and methods for real-time monitoring and control of pump operations at a well site. The methods and systems provide a pump control system that uses pump fillage with a proportional-integral-differential (PID) based algorithm to control positive displacement pump operations. The pump control system obtains or receives measured, calculated, and/or inferred pump speed from available pump speed data. From the pump speed, and using certain pump characteristics provided by the well operator, the pump control system calculates a theoretical fluid flow rate based on the pump speed. The pump control system thereafter compares the calculated theoretical fluid flow rate to a measured or observed fluid flow rate to calculate a pump fillage. The calculated pump fillage is then provided as a process input to the PID based algorithm along with a desired pump fillage from the well operator. The PID based algorithm processes the calculated pump fillage and the desired pump fillage using a tuning parameter to determine an optimum pump speed based on the desired pump fillage. The pump control system then uses the optimum pump speed determined by the PID based algorithm to adjust the speed of the pump accordingly.

In some embodiments, the pump is a PCP and the pump fillage is PCP cavity fillage. In some embodiments, the tuning parameter is determined based on pump speed and fluid flow rate observed or measured under known conditions. In alternative embodiments, the tuning parameter is derived from a table or a set of tables containing multiple pump and well parameters under various operating conditions that determine the theoretical fluid flow rate. In some embodiments, the pump control system can be augmented with additional information provided by well operators, including wellbore fluid properties, environmental conditions, measured fluid flow rate, pump age, and pump type, among other information, to further refine the theoretical fluid flow rate and provide more accurate pump fillage calculations.

In general, in one aspect, the present disclosure relates to a system a pump control system for controlling operation of a positive displacement pump at an oil and gas well. The pump control system comprises, among other things, a processor and a storage device coupled to communicate with the processor. The storage device stores computer-readable instructions thereon that, when executed by the processor, causes the pump control system to obtain a current fluid flow rate for fluids being produced from the oil and gas well, the fluids being pumped from the oil and gas well by the positive displacement pump. The computer-readable instructions also cause the pump control system to obtain a current pump speed for the positive displacement pump, the current pump speed corresponding to the current fluid flow rate for fluids being pumped from the oil and gas well by the positive displacement pump. The computer-readable instructions further cause the pump control system to calculate a theoretical fluid flow rate based on the current pump speed and one or more pump characteristics, and calculate a pump fillage based on the theoretical fluid flow rate and the current fluid flow rate. The computer-readable instructions still further cause the pump control system compare the calculated pump fillage to a target pump fillage using a pump control algorithm and one or more tuning parameters, and generate a corrected pump speed using the pump control algorithm and the one or more tuning parameters. The computer-readable instructions yet further cause the pump control system to control a motor speed of the positive displacement pump using the corrected pump speed to optimize production of fluids from the oil and gas well while minimizing wear on the positive displacement pump.

In general, in another aspect, the present disclosure relates to a method a method of controlling operation of a positive displacement pump at an oil and gas well. The method comprises, among other things, obtaining, at a pump control system, a current fluid flow rate for fluids being produced from the oil and gas well, the fluids being pumped from the oil and gas well by the positive displacement pump. The method also comprises obtaining, at the pump control system, a current pump speed for the positive displacement pump, the current pump speed corresponding to the current fluid flow rate for fluids being pumped from the oil and gas well by the positive displacement pump. The method further comprises calculating, at the pump control system, a theoretical fluid flow rate based on the current pump speed and one or more pump characteristics, and calculating, at the pump control system, a pump fillage based on the theoretical fluid flow rate and the current fluid flow rate. The method still further comprises comparing, at the pump control system, the calculated pump fillage to a target pump fillage using a pump control algorithm and one or more tuning parameters, and generating, at the pump control system, a corrected pump speed using the pump control algorithm and the one or more tuning parameters. The method yet further comprises controlling, at the pump control system, a motor speed of the positive displacement pump using the corrected pump speed to optimize production of fluids from the oil and gas well while minimizing wear on the positive displacement pump.

In general, in yet another aspect, the present disclosure relates to a computer-readable medium a computer-readable medium comprising computer-readable instructions for causing a controller to obtain a current fluid flow rate for fluids being produced from an oil and gas well, the fluids being pumped from the oil and gas well by a positive displacement pump. The computer-readable instructions also cause the controller to obtain a current pump speed for the positive displacement pump, the current pump speed corresponding to the current fluid flow rate for fluids being pumped from the oil and gas well by the positive displacement pump. The computer-readable instructions further cause the controller to calculate a theoretical fluid flow rate based on the current pump speed and one or more pump characteristics, and calculate a pump fillage based on the theoretical fluid flow rate and the current fluid flow rate. The computer-readable instructions still further cause the controller compare the calculated pump fillage to a target pump fillage using a pump control algorithm and one or more tuning parameters, and generate a corrected pump speed using the pump control algorithm and the one or more tuning parameters. The computer-readable instructions yet further cause the controller to control a motor speed of the positive displacement pump using the corrected pump speed to optimize production of fluids from the oil and gas well while minimizing wear on the positive displacement pump.

BRIEF DESCRIPTION OF THE DRAWINGS

A more detailed description of the disclosure, briefly summarized above, may be obtained by reference to various embodiments, some of which are illustrated in the appended drawings. While the appended drawings illustrate select embodiments of this disclosure, these drawings are not to be considered limiting of its scope, for the disclosure may admit to other equally effective embodiments.

Identical reference numerals have been used, where possible, to designate identical elements that are common to the figures. However, elements disclosed in one embodiment may be beneficially utilized on other embodiments without specific recitation.

DETAILED DESCRIPTION

This description and the accompanying drawings illustrate exemplary embodiments of the present disclosure and should not be taken as limiting, with the claims defining the scope of the present disclosure, including equivalents. Various mechanical, compositional, structural, electrical, and operational changes may be made without departing from the scope of this description and the claims, including equivalents. In some instances, well-known structures and techniques have not been shown or described in detail so as not to obscure the disclosure. Furthermore, elements and their associated aspects that are described in detail with reference to one embodiment may, whenever practical, be included in other embodiments in which they are not specifically shown or described. For example, if an element is described in detail with reference to one embodiment and is not described with reference to a second embodiment, the element may nevertheless be claimed as included in the second embodiment.

It is noted that, as used in this specification and the appended claims, the singular forms "a," "an," and "the," and any singular use of any word, include plural references unless expressly and unequivocally limited to one reference. As used herein, the term "includes" and its grammatical variants are intended to be non-limiting, such that recitation of items in a list is not to the exclusion of other like items that can be substituted or added to the listed items.

Figure 1:
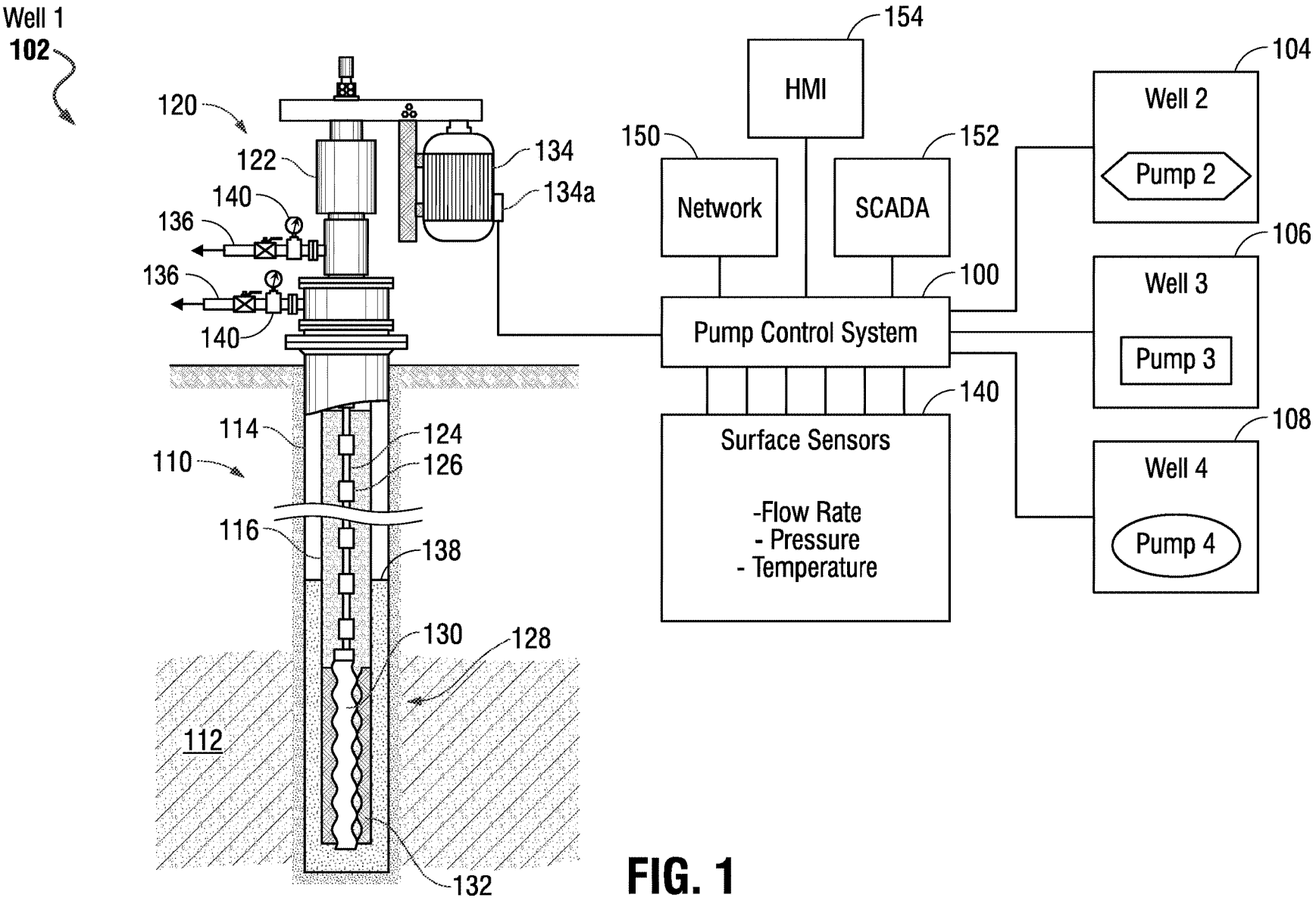
FIG. 1 is a schematic diagram illustrating oil and gas wells being controlled by a pump control system according to embodiments of the present disclosure.

Referring now to FIG. 1, a schematic diagram is shown for an exemplary pump control system 100 that can monitor and control pump operations at a well 102 according to embodiments of the present disclosure. The pump control system 100 may be any pump control systems known to those having ordinary skill in the art that has sufficient processing capacity to perform the pump monitoring and control techniques disclosed herein. Examples include programmable logic controllers (PLC), remote terminal units (RTU), programmable automation controllers (PAC), and the like. A particularly suitable example of a pump control system that may be used for the purposes herein include any one of the Realift Artificial Lift Controllers available from Schneider Electric of Boston, Massachusetts, USA.

In addition to the well 102, a typical hydrocarbon reservoir includes several additional wells that are also controlled by the control system 100, indicated here as wells 104, 106, 108 (Well 2, Well 3, Well 4). These wells may be connected to the pump control system 100 using a suitable communication link, such as Ethernet, Wi-Fi, Bluetooth, GPRS, CDMA, and the like. For economy of the present disclosure, only Well 1 is discussed in detail herein, with Well 2, Well 3, and Well 4 having similar pump arrangements (although not necessarily the same pump types). And although four wells are shown in this example, it should be appreciated that the number of wells is exemplary, and the pump control system 100 may be used to control pump operations at fewer or more wells within the scope of the present disclosure.

As can be seen, a wellbore 110 has been drilled into the subterranean formation 112 and casing 114 has been cemented in place to stabilize and protect the wellbore 110. Tubing 116 is extended into the wellbore 110 down to a certain target depth for extraction of oil, gas, and other wellbore fluids. The formation 112 in this example no longer has sufficient formation pressure to produce wellbore fluids naturally and therefore artificial lift is provided via a progressing cavity pump (PCP) 120. Those having ordinary skill in the art will appreciate that other types of positive displacement pumps may be used besides the PCP 120, such as a reciprocating pump, gear pump, screw pump, and the like.

The PCP 120 typically includes a wellhead drive 122, a rod string 124 made of individual rod segments connected by couplings 126, and a pump assembly 128 attached to the end of the rod string 124. The pump assembly 128 is composed of an elongated helical rotor 130 sealingly engaged within a stator 132 and driven (rotated) by a variable speed drive (VSD) 134 located at the surface. The oil, gas, and other wellbore fluids brought up by the PCP 120 from the wellbore 110 are then carried away by one or more flow lines 136 for processing. Wellbore fluid level is indicated at 138, which shows the level of fluid within the wellbore 110. Operation of the PCP 120 is well known to those skilled in the art and thus a detailed description is omitted here for economy.

Various types of surface sensors and instrumentation, indicated at 140, may be installed at the surface in strategic locations around the well 102 to acquire data about well operations. Any suitable sensor known to those skilled in the art may be used as the sensors 140, including wired, wireless, analog, and digital sensors. These surface sensors 140 measure and otherwise acquire data on fluid flow rate, fluid pressure, fluid temperature, and other operational parameters that affect or are affected by proper operation of the PCP 120. The sensors 140 then transmit the acquired data over a wired or wireless connection to the pump control system 100.

The pump control system 100 typically receives or obtains the data at a sampling rate of one sample per second. Different sampling rates may of course be used as needed. In addition to the sensor data, other data may also be received or obtained by the pump control system 100, including data indicating motor speed (rpm), load (torque), and other parameters. Motor speed and load are typically measured or determined by a motor controller 134*a* in the VSD 134. The motor controller 134*a* provides these parameters (or measurement data therefor) either continuously or at regularly scheduled intervals in real time to the pump control system 120.

In accordance with embodiments of the present disclosure, the pump control system 100 monitors whether the PCP 120 (and other well pumps) is operating properly. The pump control system 100 performs this monitoring using the operational parameters received or obtained from the sensors 140, the motor controller 134*a*, as well as from well operators. Specifically, the pump control system 100 uses measured or inferred current pump speed and certain pump characteristics provided by the well operator to calculate a theoretical fluid flow rate for the pump speed. The current pump speed refers to the pump speed that corresponds to or otherwise resulted in the current fluid flow rate The pump control system 100 then compares the calculated theoretical fluid flow rate to the current fluid flow rate to determine a PCP cavity fillage. The current fluid flow rate, like the current pump speed, may be measured or inferred fluid flow rate. The pump control system 100 thereafter provides the PCP cavity fillage as a process input to a PID based algorithm along with a desired PCP cavity fillage from the well operator. The PID based algorithm processes the calculated cavity fillage and the desired or target cavity fillage using one or more PID tuning parameters to determine an optimum pump speed based on the desired PCP cavity fillage. The term "fillage" as used herein refers to the amount of fluid within the pump assembly 128.

From the optimum pump speed determined by the PID based algorithm, the pump control system 100 can automatically control the motor speed of the PCP 120 (and other well pumps) to correct or prevent abnormal operation, such as a pump-off. A pump-off occurs when wellbore fluids are pumped from the wellbore at a faster rate than fluids are flowing into the wellbore from the formation. This can progressively decrease PCP cavity fillage such that the pump assembly 128 becomes insufficiently filled or no longer filled with wellbore fluids, which can potentially damage the pump assembly 128. The pump control system 100 can analyze the optimum pump speed determined by the PID based algorithm and determine the proper motor speed for the PCP 120 to ensure there is an optimum or at least sufficient amount of cavity fillage.

Importantly, the pump control system 100 does not require data for any operational parameters that are normally obtained from subsurface sensors or downhole instrumentation in order to perform the above pump monitoring and control. The pump control system 100 can perform the pump monitoring and control using operational parameters that are normally acquired by surface sensors and instrumentations. While the use of subsurface sensors and instrumentations at the well 102 (and other wells) may be needed for other purposes, such subsurface sensors are not needed to practice embodiments of the present disclosure.

In some embodiments, the pump control system 100 can also send the operational parameters (or data therefor) to a network 150 for storage and subsequent monitoring and tracking. Additionally, the pump control system 100 can transmit the operational parameters (or data therefor) to an external control system, such as a supervisory control and data acquisition (SCADA) system 152. The transmissions may take place over any suitable communication link, such as Ethernet, Wi-Fi, Bluetooth, GPRS, CDMA, and the like. From there, the data may be forwarded to other systems within an enterprise and/or to a Cloud environment (which may include a private enterprise Cloud) for further processing as needed. Further, the pump control system 100 can display certain selected operational parameters on a display, such as a human-machine-interface (HMI) 154, for review by a user. The user can then navigate the HMI 154 to manually control certain operations of the PCP 120 as needed via the pump control system 100.

Figure 2:
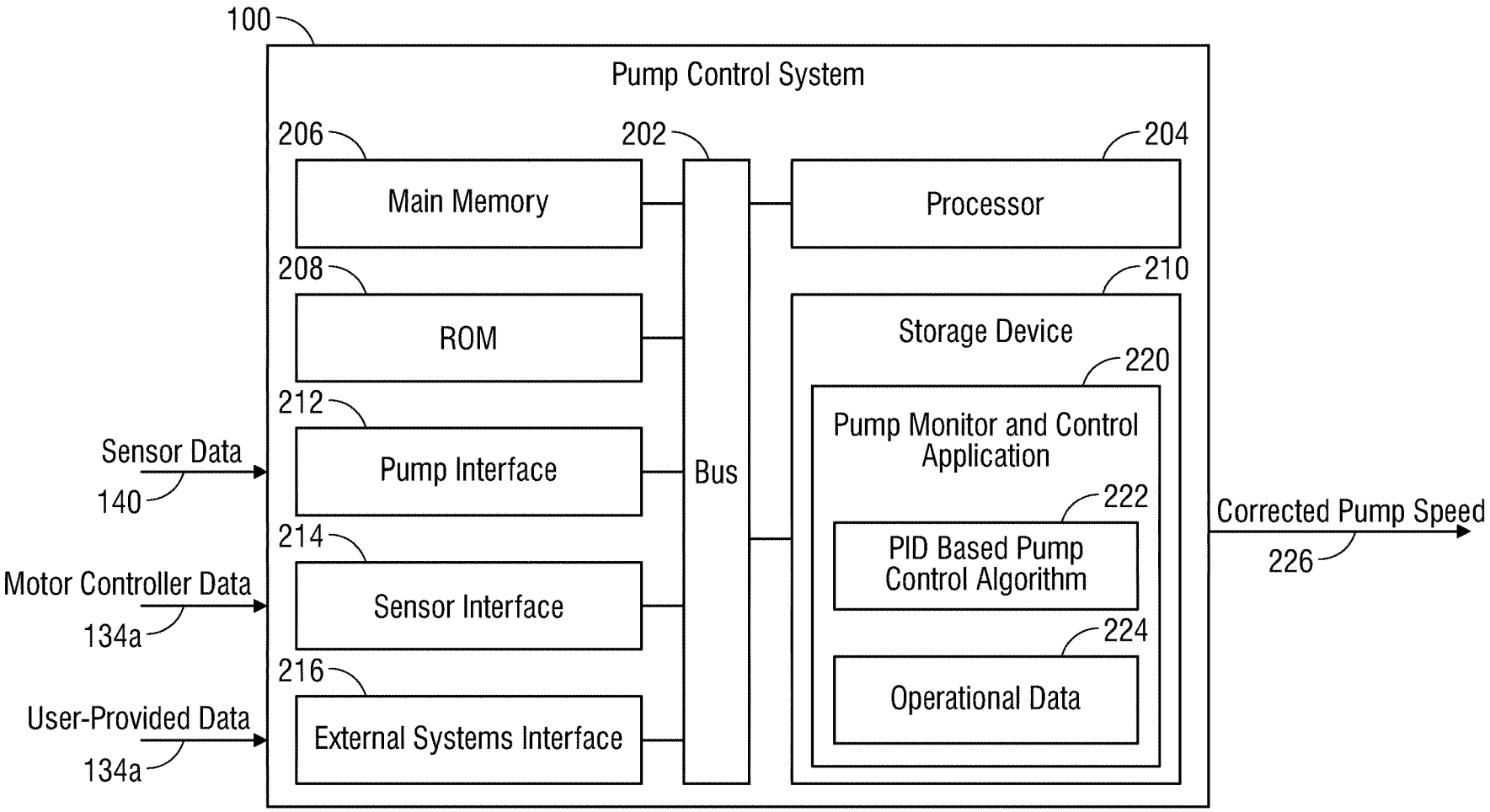
FIG. 2 is a block diagram illustrating an exemplary pump control system according to embodiments of the present disclosure.

FIG. 2 is a block diagram illustrating an exemplary pump control system 100 in accordance with embodiments of the present disclosure. In one embodiment, the pump control system 100 includes a bus 202 or other communication pathway for transferring data within the pump control system, and a processor 204, which may be any suitable microprocessor or microcontroller, coupled with the bus 202 for processing the information. The pump control system 100 may also include a main memory 206 coupled to the bus 202 for storing computer-readable instructions to be executed by the processor 204. The main memory 206 may also be used for storing temporary variables or other intermediate information during execution of the instructions by the processor 204.

The pump control system 100 may further include a read-only memory (ROM) 208 or other static storage device coupled to the bus 202 for storing static information and instructions for the processor 204. A computer-readable storage device 210, such as a nonvolatile memory (e.g., Flash memory) drive or magnetic disk, may be coupled to the bus 202 for storing information and instructions for the processor 204. The processor 204 may also be coupled via the bus 202 to a well pump interface 212 for allowing the pump control system 100 to communicate with the PCP 120 and other well pumps at the wells connected thereto. A sensor interface 214 may be coupled to the bus 202 for allowing the pump control system 100 to communicate with the various sensors 140 mounted at the wells. An external systems interface 216 may be coupled to the bus 202 for allowing the pump control system 100 to communicate with various external systems, such as a touchscreen or HMI (e.g., HMI 154), SCADA system (e.g., SCADA system 152), network (e.g., network 150), and the like.

The term "computer-readable instructions" as used above refers to any instructions that may be performed by the processor 204 and/or other components. Similarly, the term "computer-readable medium" refers to any storage medium that may be used to store the computer-readable instructions. Such a medium may take many forms, including, but not limited to, non-volatile media, volatile media, and transmission media. Non-volatile media may include, for example, optical or magnetic disks, such as the storage device 210. Volatile media may include dynamic memory, such as main memory 206. Transmission media may include coaxial cables, copper wire and fiber optics, including wires of the bus 202. Transmission itself may take the form of electromagnetic, acoustic or light waves, such as those generated during radio frequency (RF) and infrared (IR) data communications. Common forms of computer-readable media may include, for example, magnetic medium, optical medium, memory chip, and any other medium from which a computer can read.

A pump monitor and control application 220, or rather the computer-readable instructions therefor, may also reside on or be downloaded to the storage device 210. The pump monitor and control application 220 may then be executed by the processor 204 (and other components) to automatically monitor and correct as well as prevent abnormal operations, such as insufficient cavity fillage, at the well 102 (and other wells) based on data from the sensors 140, the pump controller 134, and/or user provided data via the HMI 154. The pump monitor and control application 220 can then generate a pump speed control signal 226 indicating a corrected pump speed to adjust the pump speed of the PCP 120 accordingly. Such a pump monitoring and control application 220 may be written in any suitable computer programming language known to those skilled in the art, such as C, C++, C#, Python, Java, Perl, and the like.

In accordance with embodiments of the present disclosure, the pump monitor and control application 220 may include, or have access to, a pump control algorithm 222 for determining pump fillage at the PCP 120 (and other well pumps). In the example shown, the pump control algorithm 222 is a PID based pump control algorithm, although other types of pump control algorithms may be used. The pump monitor and control application 220 may further include, or have access to, operational data 224 for one or more operational parameters for the various well pumps. The operational parameters may be provided by the sensors 140, the pump controller 134, as well as users via the HMI 154. Such operational data 224 may be obtained and stored by the pump control system 100 at regular intervals (e.g., per second, per minute, per hour, etc.) so the data required by the pump control algorithm 222 is readily available and current (within a specified quality-of-service (QOS) level).

In general operation, the pump control algorithm 222 uses a PID based control loop to monitor and correct the cavity fillage in the PCP 120. When the cavity fillage drops, this likely means the rate of fluid flowing into the wellbore 110 no longer supports the rate of fluid being produced from the wellbore 110. When this happens, fluid production from the wellbore usually decreases and, depending on the extent of the drop in cavity fillage, damage to the pump assembly 128 can occur because there is not enough fluid to properly lubricate the pump assembly 128. The pump control algorithm 222 corrects for falling cavity fillage by reducing PCP pump speed so that the rate of fluid produced again roughly matches the rate of fluid flow into the PCP 120. The pump control algorithm 222 accomplishes this correction by using the PID based control loop and one or more PID tuning parameters. The PID based control loop and the PID tuning parameters help to restore or maintain the amount of wellbore fluid within the pump assembly 128, and hence the cavity fillage, at a sufficient level to minimize or remove instabilities in fluid production.

PID control loops are a form of "closed loop" control that are commonly used to control a wide variety of processes. In a PID control loop, a process variable is monitored and provided as feedback to a controller. The controller outputs a control signal that adjusts a certain aspect of the process to control the process variable toward a target setpoint value. The types of process variables that are amenable to PID control loops include pressure, temperature, heat-up rate, relative and absolute position, orientation, rpm, velocity, acceleration, and the like. This PID control loop can be expressed mathematically as follows:

$$\text{ProcessError}=\text{ActualValue}-\text{TargetValue} \tag{1}$$

$$\begin{aligned}\text{ControlOutput}=&(Kp^*\text{ProcessError})+\\&(Ki^*\text{AccumulatedProcessError})+\\&(Kd^*\text{ProcessRateofChange})\end{aligned} \tag{2}$$

where Kp, Ki, and Kd are proportional, integral, and derivative tuning parameters, respectively. An operator or programmer can tune these Kp, Ki, and Kd tuning parameters as needed to prevent or minimize overshoot and other considerations based in part on how slowly or quickly the system responds, for example. Various techniques are known to those having ordinary skill in the art for determining appropriate tuning parameter values for a given application, including tuning by trial and error. However done, the objective is to derive tuning parameter values such that there is minimal process oscillation around the setpoint after occurrence of a perturbation.

Figure 3:
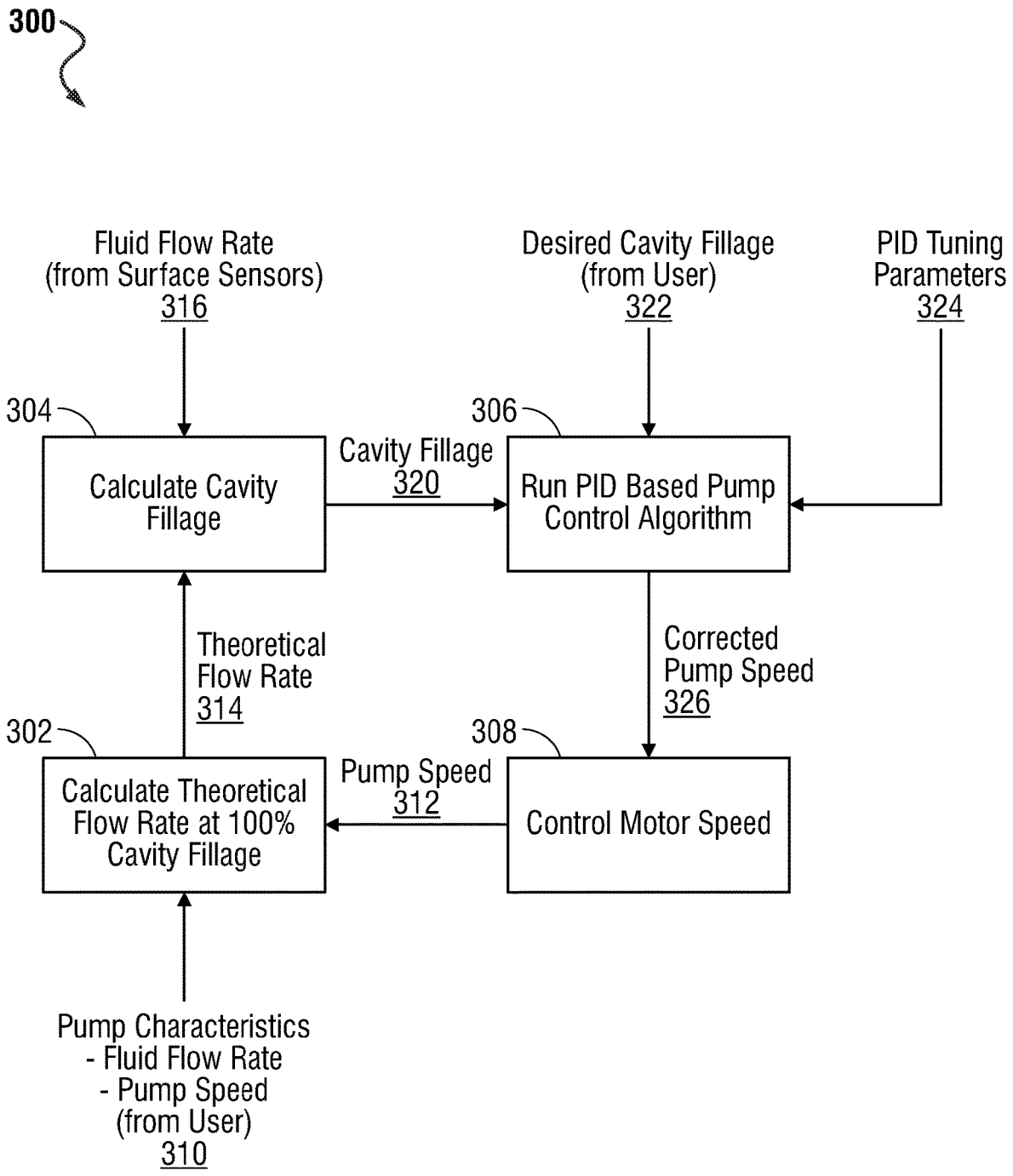
FIG. 3 is a functional diagram illustrating a pump control algorithm according to embodiments of the present disclosure.

FIG. 3 is a functional diagram showing an exemplary PID based control loop 300 that may be used by or with the pump control algorithm 222 according to some embodiments. The PID based control loop 300 generally operates to calculate an error as the difference between a desired or target PCP cavity fillage and an observed or measured cavity fillage, and applies a correction based on the PID tuning parameter. PID tuning parameters are well known in the art and are usually derived specifically for each control application, as their values usually depend on the response characteristics of every element in the control application.

As the FIG. 3 example shows, the PID based control loop 300 has several process blocks, including a block 302 that calculates the theoretical flow rate for the PCP assuming the cavity fillage is 100%, a block 304 that calculates the cavity fillage, a block 306 that executes a PID based pump control algorithm, and a block 308 that controls the PCP motor speed. There are also a number of process inputs into the various process blocks 302, 304, 306, 308, as discussed below.

At process block 302, PCP pump characteristics 310 and current PCP pump speed 312 are received as process inputs. The PCP pump characteristics 310 are generally known for a given pump and can be input by well operators or can be derived from a database containing such data. These pump characteristics 310 may include, for example, the optimum fluid flow rate for the pump, the optimum pump speed for the pump, and the fluid to surface time, among other characteristics. The current pump speed 312 can be a measured pump speed as provided by the motor controller 134*a*, which continuously tracks the pump speed. Alternatively, the current pump speed may be inferred by the pump control system 100 using parameters such as motor speed, motor load, and fluid flow rate, among other parameters. Techniques for inferring PCP pump speed are well known to those having ordinary skill in the art. From these process inputs 310, 312, process block 302 calculates a theoretical flow rate 314 for the PCP under an assumption that the cavity fillage is 100%, and provides this theoretical flow rate to process block 304.

At process block 304, fluid flow rate 316 is received as a process input along with the theoretical flow rate 314 from process block 302. The fluid flow rate 316 is preferably the current fluid flow rate corresponding to or resulting from the current pump speed, as acquired by the sensors 140. Alternatively, the current fluid flow rate 316 may be inferred by the pump control system 100 using parameters such as motor speed and motor load, among other parameters. Techniques for inferring fluid flow rate are well known to those having ordinary skill in the art. From these process inputs 314, 316, process block 302 calculates a cavity fillage 320 and provides this calculated cavity fillage 320 to process block 306. In some embodiments, process block 304 may calculate the cavity fillage 320 as follows:

$$\text{Cavity Fillage} = 100\% * \frac{(\text{FlowFromPump})}{(K * \text{PumpSpeed})} \tag{3}$$

where the numerator, FlowFromPump, is the measured or inferred fluid flow rate (e.g., in gallons per minute (gpm)) and the denominator is the theoretical flow rate (e.g., in revolutions per minute (rpm)). In the denominator, PumpSpeed is the measured or inferred current pump speed, and K is a pump displacement value that represents the expected fluid flow per unit of pump speed when the cavity fillage is 100%. The theoretical flow rate can then be calculated by multiplying the PumpSpeed and the pump displacement value K.

In Equation (3), the pump displacement value K may be a preset constant (e.g., 0.110 gallons per revolution, 0.124 gallons per revolution, etc.) based on the specific type of pump, or K may be a calculated value. If calculated, the value of K can be calculated from the pump geometry or by testing the pump in operation under controlled operating conditions, such as a certain pump speed, certain pumped fluid properties, certain pump age or wear, certain pump discharge pressure, and the like. Alternatively, K can be calculated using a table (or set of tables) of parameters related to pump conditions or well fluid properties. Such a table (or tables) may take the form of a chart (or charts) in which the table entries are plotted as data points on the chart.

At process block 306, a desired or target cavity fillage 322 is received as a process input from the well operator along with the calculated cavity fillage 320 from process block 304. The process block 306 then provides these inputs to a pump control algorithm, such as a PID based pump control algorithm. PID based control algorithms are generally well understood by those having ordinary skill in the art. Basically, a PID control algorithm operates to automatically apply an accurate and responsive correction to a control function using one or more of the tuning parameters Kp, Ki, and Kd discussed above. In the present case, the PID based pump control algorithm at process block 306 calculates an error as the difference between the calculated cavity fillage 320 and the desired or target cavity fillage 322, and uses one or more tuning parameters 324 to correct the error. The PID based pump control algorithm at process block 306 then determines a corrected pump speed 326 that would be needed to correct the difference between the calculated cavity fillage 320 and the desired or target cavity fillage 322. Process block 306 thereafter provides the corrected pump speed 326 to the pump control system 100 to be used to control the pump motor.

Figure 4:
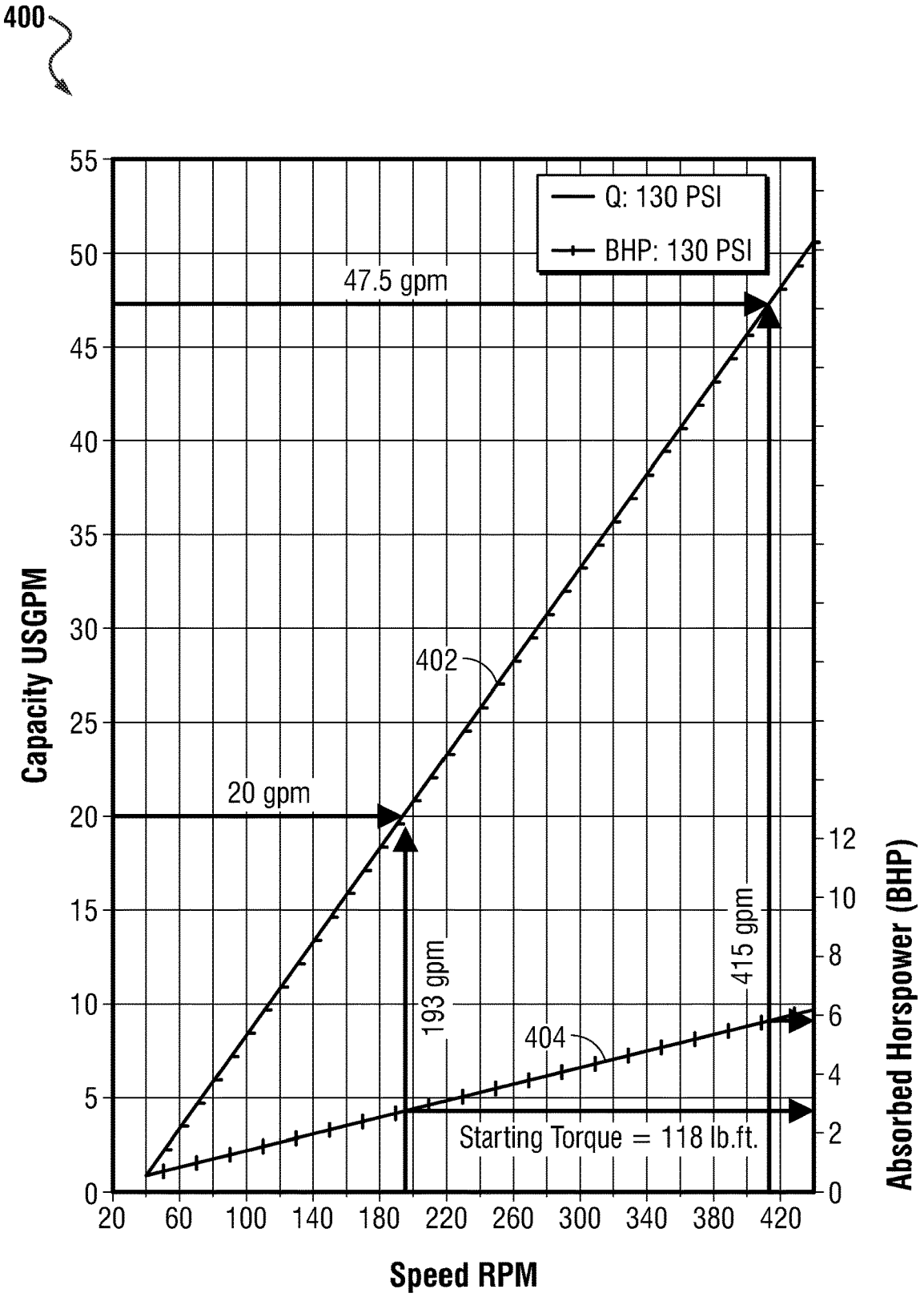
FIG. 4 is a chart illustrating exemplary pump characteristics according to embodiments of the present disclosure.

FIG. 4 shows an exemplary table in the form of a chart 400 that may be used to determine a pump displacement value K based on the pump speed in some embodiments. The chart 400 in this example is for a BN 10-12 progressing cavity pump available from Seepex. In the chart 400, the vertical axis indicates pump capacity or fluid flow rate in United States gallons per minute (USGPM) and the horizontal axis indicates pump speed in rpm. Line 402 represents the relationship between the fluid flow rate and the pump speed for this particular pump at a pressure differential of 130 psi. Similarly, line 404 represents the relationship between absorbed or braking horsepower (BHP) and the pump speed for this particular pump at a 130 psi pressure differential. The pump displacement value K at a given pump speed can be determined by taking a ratio of the fluid flow rate at the given pump speed over the pump speed. Thus, for example, the pump displacement value K at a pump speed of 193 rpm is 0.103 gallons per revolution (i.e., 20 gpm/193 rpm).

Figure 5:
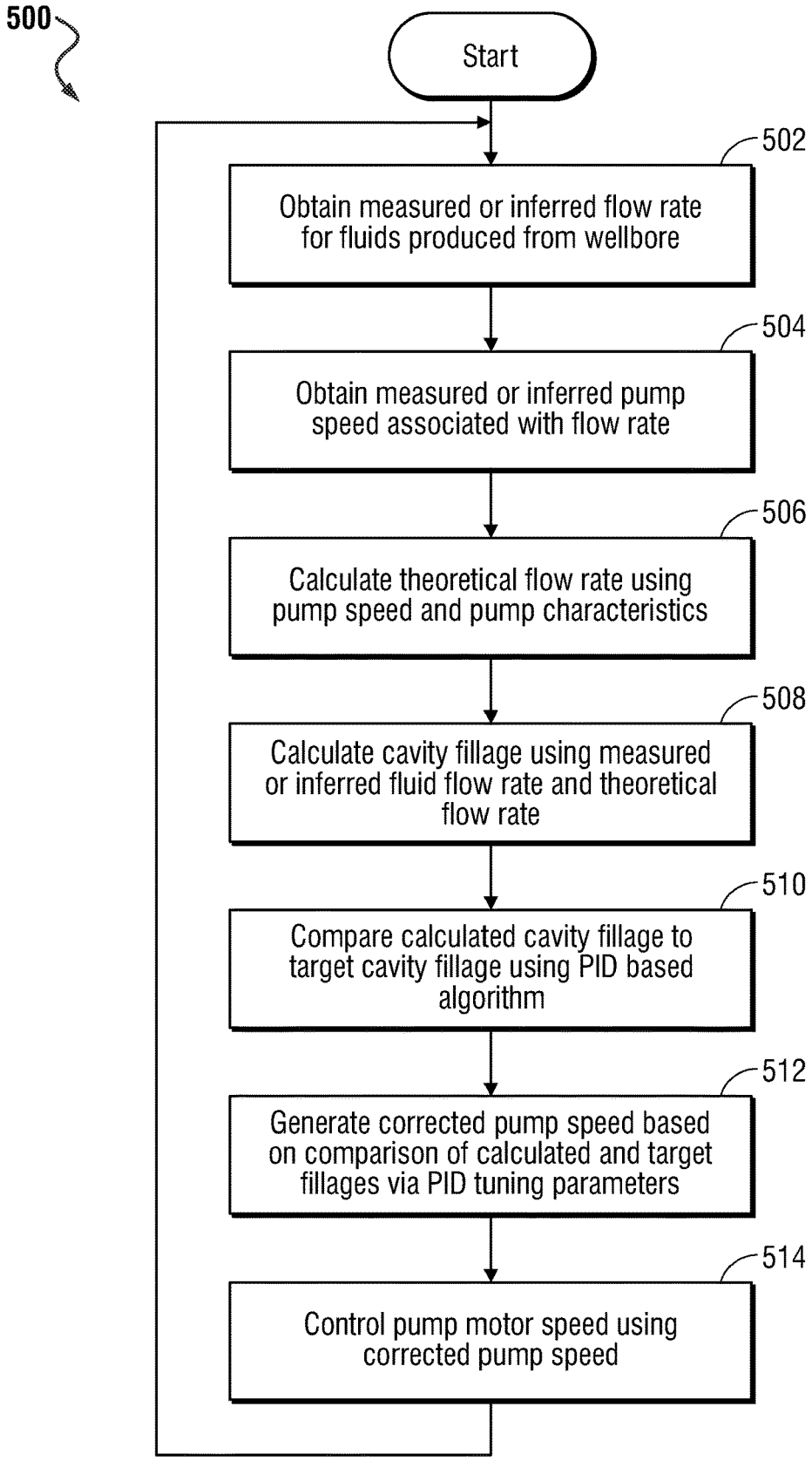
FIG. 5 is a flow diagram illustrating an exemplary method that may be used by a pump control system according to embodiments of the present disclosure.

Thus far, specific embodiments of a pump control system have been described according to the present disclosure. Referring now to FIG. 5, a flowchart 500 is shown representing a general method that may be used with or by a pump control system according to embodiments of the present disclosure. The method may be used to control any type of positive displacement pump, and is particularly well suited for use with PCP type pumps.

As can be seen in FIG. 5, the flowchart 500 generally begins at 502 where the pump control system receives or obtains fluid flow rate for the fluids produced from a well. The fluid flow rate may be the current fluid flow rate as measured or observed by one or more surface sensors mounted around the well, or the fluid flow rate may be inferred by the pump control system from pump operational parameters, such as current motor speed and motor load, among other parameters.

At 504, the pump control system receives or obtains pump speed for the pump. The pump speed may be the current pump speed that corresponds to or resulted in the current fluid flow rate, as measured or observed by a pump controller. Alternatively, the current pump speed may be inferred by the pump control system from pump operational parameters, such as motor speed, motor load, and fluid flow rate, among other parameters.

At 506, the pump control system calculates a theoretical flow rate assuming 100% cavity fillage for the pump. This theoretical flow rate may be calculated using the pump speed received or obtained above at 504 along with certain pump characteristics provided by well operators. The pump characteristics may include, for example, the pump displacement value K, the optimum fluid flow rate, and the fluid to surface time, among other pump characteristics.

At 508, the pump control system calculates a cavity fillage using the fluid flow rate received or obtained above at 502 along with the theoretical flow rate calculated above at 506. In some embodiments, the pump control system may calculate the cavity fillage using Equation (3), where K may be a preset constant, or it may be calculated from the pump geometry or by testing the pump while operating under controlled conditions of pump speed and pumped fluid properties. Alternatively, K can be calculated using a table (or set of tables) of parameters related to pump conditions or well fluid properties (see FIG. 4).

At 510, the pump control system compares the calculated cavity fillage from 508 above with a desired or target cavity fillage provided by a well operator. In some embodiments, the pump control system compares the calculated and targeted cavity fillages using a PID based pump control algorithm. The PID based pump control algorithm determines an error as the difference between the calculated cavity fillage and the desired or target cavity fillage. In some embodiments, the PID base pump control algorithm may take the form of a PID control loop.

At 512, the pump control system generates a corrected pump speed based on the comparison of the calculated and targeted cavity fillages performed above at 510 using one or more of the PID tuning parameters Kp, Ki, and Kd mentioned earlier.

Thereafter, at 514, the pump control system controls the pump motor speed using the corrected pump speed from 512 to bring the calculated cavity fillage closer to the target cavity fillage. This helps to correct or prevent abnormal pump operations, such as a pump-off, and keeps the PCP operating in optimal condition. The flowchart 500 then returns to 502 to repeat the process on a continuous basis or as regularly scheduled.

Figure 6:
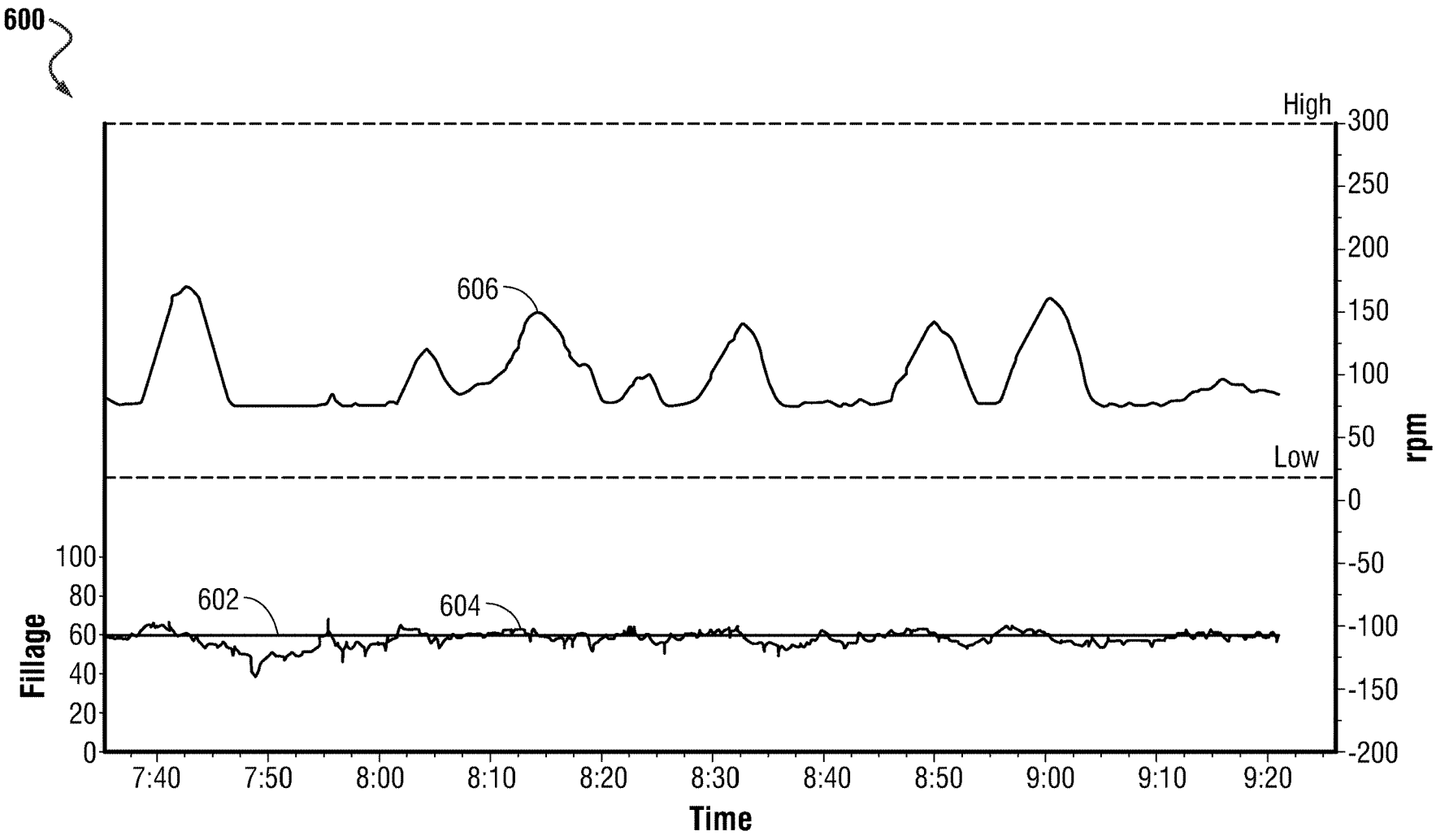
FIG. 6 is a graph illustrating exemplary monitoring and controlling of pump operations by a pump control system according to embodiments of the present disclosure.

Turning now to FIG. 6, a graph 600 is shown illustrating an example of the pump control system monitoring and controlling a well pump to correct or prevent abnormal operations using pump fillage and a PID based pump control algorithm. In the exemplary graph 600, the left vertical axis indicates pump fillage ranging from 0 to 100%, the right vertical axis indicates pump motor speed ranging from −200 to 300 rpm, and the horizontal axis indicates clock time ranging from 7:40 to 9:20. Line 602 represents a target pump fillage or setpoint, line 604 represents a calculated pump fillage, and line 606 represents measured or observed motor speed. In the example, the well pump is a PCP type pump and the PID based pump control algorithm uses PID tuning parameters Kp, Ki, and Kd that have been tuned specifically to optimize production of well fluids via the PCP. As can be seen, the pump control system is able to adjust motor speed (line 606) in real time (or near real time) to maintain the calculated pump fillage (line 604) at or near (e.g., within about 20%) the setpoint (line 602) with minimal oscillations.

In the preceding discussion, reference is made to various embodiments. However, the scope of the present disclosure is not limited to the specific described embodiments. Instead, any combination of the described features and elements, whether related to different embodiments or not, is contemplated to implement and practice contemplated embodiments. Furthermore, although embodiments may achieve advantages over other possible solutions or over the prior art, whether or not a particular advantage is achieved by a given embodiment is not limiting of the scope of the present disclosure. Thus, the preceding aspects, features, embodiments and advantages are merely illustrative and are not considered elements or limitations of the appended claims except where explicitly recited in a claim(s).

The various embodiments disclosed herein may be implemented as a system, method or computer program product. Accordingly, aspects may take the form of an entirely hardware embodiment, an entirely software embodiment (including firmware, resident software, micro-code, etc.) or an embodiment combining software and hardware aspects that may all generally be referred to as a "circuit," "module" or "system." Furthermore, aspects may take the form of a computer program product embodied in one or more computer-readable medium(s) having computer-readable program code embodied thereon.

Any combination of one or more computer-readable medium(s) may be utilized. The computer-readable medium may be a non-transitory computer-readable medium. A non-transitory computer-readable medium may be, for example, but not limited to, an electronic, magnetic, optical, electromagnetic, infrared, or semiconductor system, apparatus, or device, or any suitable combination of the foregoing. More specific examples (a non-exhaustive list) of the non-transitory computer-readable medium can include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. Program code embodied on a computer-readable medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages. Moreover, such computer program code can execute using a single computer system or by multiple computer systems communicating with one another (e.g., using a private area network (PAN), local area network (LAN), wide area network (WAN), the Internet, etc.). While various features in the preceding are described with reference to flowchart illustrations and/or block diagrams, a person of ordinary skill in the art will understand that each block of the flowchart illustrations and/or block diagrams, as well as combinations of blocks in the flowchart illustrations and/or block diagrams, can be implemented by computer logic (e.g., computer program instructions, hardware logic, a combination of the two, etc.). Generally, computer program instructions may be provided to a processor(s) of a general-purpose computer, special-purpose computer, or other programmable data processing apparatus. Moreover, the execution of such computer program instructions using the processor(s) produces a machine that can carry out a function(s) or act(s) specified in the flowchart and/or block diagram block or blocks.

The flowchart and block diagrams in the Figures illustrate the architecture, functionality and/or operation of possible implementations of various embodiments of the present disclosure. In this regard, each block in the flowchart or block diagrams may represent a module, segment or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It is to be understood that the above description is intended to be illustrative, and not restrictive. Many other implementation examples are apparent upon reading and understanding the above description. Although the disclosure describes specific examples, it is recognized that the systems and methods of the disclosure are not limited to the examples described herein, but may be practiced with modifications within the scope of the appended claims. Accordingly, the specification and drawings are to be regarded in an illustrative sense rather than a restrictive sense. The scope of the disclosure should, therefore, be determined with reference to the appended claims, along with the full scope of equivalents to which such claims are entitled.

We claim:

1. A pump control system for controlling operation of a positive displacement pump at an oil and gas well, comprising:

a processor; and a storage device coupled to communicate with the processor, the storage device storing computer-readable instructions thereon that, when executed by the processor, causes the pump control system to:

obtain a current fluid flow rate for fluids being produced from the oil and gas well, the fluids being pumped from the oil and gas well by the positive displacement pump;

obtain a current pump speed for the positive displacement pump, the current pump speed corresponding to the current fluid flow rate for fluids being pumped from the oil and gas well by the positive displacement pump;

calculate a theoretical fluid flow rate based on the current pump speed and one or more pump characteristics;

calculate a pump fillage based on the theoretical fluid flow rate and the current fluid flow rate;

compare the calculated pump fillage to a target pump fillage using a pump control algorithm and one or more tuning parameters;

generate a corrected pump speed using the pump control algorithm and the one or more tuning parameters; and control a motor speed of the positive displacement pump using the corrected pump speed to optimize production of fluids from the oil and gas well while minimizing wear on the positive displacement pump.

2. The pump control system of claim 1, wherein the calculated pump fillage is calculated based on a ratio of the current fluid flow rate over the current pump speed and a pump displacement value.

3. The pump control system of claim 1, wherein the positive displacement pump is a progressing cavity pump (PCP) and the pump fillage is cavity fillage.

4. The pump control system of claim 1, wherein the pump control algorithm is a proportional-integral-differential (PID) based pump control algorithm and the one or more tuning parameters are PID tuning parameters.

5. The pump control system of claim 1, wherein the current pump speed is one of measured pump speed, or inferred pump speed.

6. The pump control system of claim 1, wherein the current fluid flow rate is one of measured fluid flow rate, or inferred fluid flow rate.

7. The pump control system of claim 1, wherein the current fluid flow rate is acquired from sensors located at or above a surface of the oil and gas well.

8. A method of controlling operation of a positive displacement pump at an oil and gas well, comprising:

obtaining, at a pump control system, a current fluid flow rate for fluids being produced from the oil and gas well, the fluids being pumped from the oil and gas well by the positive displacement pump;

obtaining, at the pump control system, a current pump speed for the positive displacement pump, the current pump speed corresponding to the current fluid flow rate for fluids being pumped from the oil and gas well by the positive displacement pump;

calculating, at the pump control system, a theoretical fluid flow rate based on the current pump speed and one or more pump characteristics;

calculating, at the pump control system, a pump fillage based on the theoretical fluid flow rate and the current fluid flow rate;

comparing, at the pump control system, the calculated pump fillage to a target pump fillage using a pump control algorithm and one or more tuning parameters;

generating, at the pump control system, a corrected pump speed using the pump control algorithm and the one or more tuning parameters; and controlling, at the pump control system, a motor speed of the positive displacement pump using the corrected pump speed to optimize production of fluids from the oil and gas well while minimizing wear on the positive displacement pump.

9. The method of claim 8, wherein the calculated pump fillage is calculated based on a ratio of the current fluid flow rate over the current pump speed and a pump displacement value.

10. The method of claim 8, wherein the positive displacement pump is a progressing cavity pump (PCP) and the pump fillage is cavity fillage.

11. The method of claim 8, wherein the pump control algorithm is a proportional-integral-differential (PID) based pump control algorithm and the one or more tuning parameters are PID tuning parameters.

12. The method of claim 8, wherein the current pump speed is one of measured pump speed, or inferred pump speed.

13. The method of claim 8, wherein the current fluid flow rate is one of measured fluid flow rate, or inferred fluid flow rate.

14. The method of claim 8, wherein the current fluid flow rate is acquired from sensors located at or above a surface of the oil and gas well.

15. A computer-readable medium comprising computer-readable instructions for causing a controller to:

obtain a current fluid flow rate for fluids being produced from an oil and gas well, the fluids being pumped from the oil and gas well by a positive displacement pump;

obtain a current pump speed for the positive displacement pump, the current pump speed corresponding to the current fluid flow rate for fluids being pumped from the oil and gas well by the positive displacement pump;

calculate a theoretical fluid flow rate based on the current pump speed and one or more pump characteristics;

calculate a pump fillage based on the theoretical fluid flow rate and the current fluid flow rate;

compare the calculated pump fillage to a target pump fillage using a pump control algorithm and one or more tuning parameters;

generate a corrected pump speed using the pump control algorithm and the one or more tuning parameters; and control a motor speed of the positive displacement pump using the corrected pump speed to optimize production of fluids from the oil and gas well while minimizing wear on the positive displacement pump.

16. The computer-readable medium of claim 15, wherein the controller calculates the calculated pump fillage based on a ratio of the current fluid flow rate over the current pump speed and a pump displacement value.

17. The computer-readable medium of claim 15, wherein the positive displacement pump is a progressing cavity pump (PCP) and the pump fillage is cavity fillage.

18. The computer-readable medium of claim 15, wherein the controller compares the calculated pump fillage to the target pump fillage using a proportional-integral-differential (PID) based pump control algorithm and one or more PID tuning parameters.

19. The computer-readable medium of claim 15, wherein the current pump speed is one of measured pump speed or inferred pump speed, and the current fluid flow rate is one of measured fluid flow rate or inferred fluid flow rate.

20. The computer-readable medium of claim 15, wherein the current fluid flow rate is acquired from sensors located at or above a surface of the oil and gas well.

* * * * *